US007515118B2

(12) United States Patent
Kubota et al.

(10) Patent No.: US 7,515,118 B2
(45) **Date of Patent: *Apr. 7, 2009**

(54) PLASMA DISPLAY DEVICE

(75) Inventors: Hidenao Kubota, Yokohama (JP); Hirofumi Sakamoto, Fujisawa (JP); Masahiko Umeda, Yokohama (JP); Masatoshi Sudo, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 402 days.

This patent is subject to a terminal disclaimer.

(21) Appl. No.: 11/454,062

(22) Filed: Jun. 14, 2006

(65) Prior Publication Data

US 2006/0232514 A1 Oct. 19, 2006

Related U.S. Application Data

(63) Continuation of application No. 10/120,859, filed on Apr. 10, 2002, now Pat. No. 7,113,153.

(30) Foreign Application Priority Data

Jul. 13, 2001 (JP) ..... 2001-213037

(51) Int. Cl.
*G09G 3/28* (2006.01)

(52) U.S. Cl. ..... 345/60; 345/66

(58) Field of Classification Search ..... 345/41–42, 345/47, 55, 60–68; 315/169–169.4
See application file for complete search history.

(56) References Cited

U.S. PATENT DOCUMENTS 4,458,244 A 7/1984 Yamaguchi et al.
6,144,349 A 11/2000 Awata et al.
6,333,599 B1 12/2001 Kawanami et al.
6,356,017 B1 3/2002 Makino
6,396,508 B1 5/2002 Noecker
6,400,347 B1 6/2002 Kang
6,522,072 B1 2/2003 Yura et al.
6,603,448 B2 8/2003 Kado
6,853,359 B2 2/2005 Hashimoto
7,126,562 B1 * 10/2006 Irie et al. ..... 345/63

FOREIGN PATENT DOCUMENTS

JP 08-297480 A 11/1996

(Continued)

OTHER PUBLICATIONS

Japan Patent Office (JPO) office action dated for JPO patent application JP2001-213037 (Jun. 30, 2008).

*Primary Examiner*—Richard Hjerpe
*Assistant Examiner*—Mansour M Said
(74) *Attorney, Agent, or Firm*—Townsend and Townsend and Crew LLP

(57) ABSTRACT

The initial color temperature setting can change when a plasma display panel (PDP) is driven for a long period of time. One cause is due to the non-uniform deterioration of red, green, and blue fluorescent materials due to the ultraviolet rays discharged during operation of the panel. Color temperature correction is performed by setting the numbers of discharge pulses for fluorescent materials in accordance with a discharge pulse number correction curve with respect to the cumulative elapsed driven time of the PDP.

18 Claims, 10 Drawing Sheets

FOREIGN PATENT DOCUMENTS

| | | | |
|---|---|---|---|
| JP | 09-319931 | A | 12/1997 |
| JP | 10-333639 | A | 12/1998 |
| JP | 11-119728 | A | 4/1999 |
| JP | 11-265165 | A | 9/1999 |
| JP | 11-205722 | A | 11/1999 |
| JP | 2000-115802 | A | 4/2000 |

* cited by examiner

PLASMA DISPLAY DEVICE

BACKGROUND OF THE INVENTION

The present invention relates to a display device employing a plasma display panel that displays television images and so forth and, particularly, to a display device that can improve a reduction in color temperature accompanying deterioration of fluorescent materials caused by electrical discharge in the plasma display panel.

A plasma display panel display device using a plasma display panel (hereinafter referred to as "PDP") is a variation of display devices having a low profile and capable of displaying television images and so forth. The PDP display device is suitable for a large screen display and, therefore, attracts public attention.

The PDP utilizes the excited emission phenomenon of fluorescent materials induced by ultraviolet rays that are generated by discharge of a rare gas such as Ne (neon), Xe (xenon) and the like. FIG. 7 is a perspective view showing an example of a panel configuration of an AC type PDP. In FIG. 7, reference numeral 100 denotes a PDP; 101 denotes a glass substrate that is a substrate on the display face side; 102 denotes a pair of display electrodes formed on the glass substrate 101, the pair of display electrodes consisting of an X display electrode 102*x* and a Y display electrode 102*y*, each of the X and Y display electrodes consisting of a transparent electrode 120*a* and a metal assist plate 120*b* for reducing resistance. Reference numeral 103 denotes a dielectric layer covering the pair of display electrodes 102; 104 denotes a protection film made of MgO covering the pair of display electrodes 102 and the dielectric layer 103. Reference numeral 121 denotes a back face side glass substrate disposed to oppose to the glass substrate 101; 125 denotes address electrodes disposed on the glass substrate 121 in the form of stripes; 122 denotes partitions disposed adjacent to the address electrodes. Reference numeral 123 denotes fluorescent materials applied to the address electrodes 125 to cover them. A red fluorescent material (R), a green fluorescent material (G) and a blue fluorescent material (B) are applied to three address electrodes, respectively, which constitute a pixel. Reference numeral 124 denotes discharge spaces enclosed by the partitions 122 disposed between the substrate on the display electrodes side and the substrate on the fluorescent materials side. Each of the discharge spaces is filled with the rare gas such as Ne, Xe or the like. Discharge cells shown in FIG. 9 are arranged in the form of a matrix.

FIG. 8 is a schematic diagram showing a discharge mechanism of the PDP, wherein parts shown in FIG. 7 are denoted by the same reference numerals and the explanation thereof is omitted. In FIG. 8, a voltage is applied from a driving circuit (not shown) to each of the address electrodes 125 and the Y display electrode 102*y* (this operation will be referred to as "address drive" in the following description) to allow a pilot discharge (this discharge will be referred to as "address discharge" in the following description). In addition, a voltage (this voltage will be referred to as "sustain voltage" in the following description) is applied to each of the X display electrode 102*x* and the Y display electrode 102*y* (this operation will be referred to as "sustain drive" in the following description) to sustain the discharge (this discharge will be referred to as "sustain discharge" in the following description). The discharges in the discharge space 124 caused by the application of voltages to the electrodes described above cause ultraviolet rays that excite the fluorescent materials 123 to generate red light, green light and blue light, and the light passes through the transparent glass substrate disposed on the display electrodes side.

FIG. 10 shows a display method of the PDP. Since it is difficult for the PDP to display a halftone between emission and non-emission, generally, the PDP employs a method called "subfield method" to display the halftone. In the subfield method, a time span for one field is divided into a plurality of subfields (SF), and a specific emission weight is assigned to each of the subfields to control the emission and the non-emission of each of the subfields, thereby achieving a gradation in brightness of the field. One subfield consists of control pulses for controlling: a reset period for initializing a state of a discharge cell; an address period for controlling lighting/non-lighting of the discharge cell; and a sustain period for determining an emission amount. In FIG. 10, one field is divided into eight subfields (SF1 to SF8) since about 256 gradations (8 bits) are required for achieving display without deteriorating the image signals, and a number of sustain discharges is so set that a relative ratio among brightness during the sustain discharges of the subfields will be 1:2:4:8:16:32:64:128. A sustain voltage waveform applied to each of the X and Y display electrodes for the sustain discharge has a rectangular shape, and the number of sustain discharges described above is equal to the number of pulses applied for the sustain drive (hereinafter referred to as "number of discharge pulses"). Combination of the emission and the non-emission by the subfield unit as explained above allows the setting of the brightness of 256 gradation levels of from 0 to 255 for each of the colors R, G and B. In FIG. 10, the reset period is included in the address period to simplify the drawing.

SUMMARY OF THE INVENTION

It is generally known that fluorescent materials are deteriorated due to discharges in a PDP, and the deterioration is in the order of a blue fluorescent material, a green fluorescent material and a red fluorescent material. In particular, the deterioration of fluorescent material ($BaMgAl_{14}O_{23}$:Eu) used for the blue light is remarkable as compared with those of the red and green fluorescent materials. Hence, research on blue fluorescent materials with less deterioration have been conducted to find that the deterioration of the blue fluorescent material can be reduced by changing the composition thereof from $BaMgAl_{14}O_{23}$:Eu to $BaMgAl_{14}O_{17}$:Eu.

Under the circumstances as mentioned above, the PDP display device has recently been used as a household television and so on in addition to the business use. A PDP display device that can achieve a high color temperature and brightness as those realized by a cathode ray tube, which is a general display device for television, is now in demand in the market. Therefore, the present inventors have conducted researches concerning the PDP device in such a manner that the number of discharge pulses for blue fluorescent material is increased to be larger than those for the red and green fluorescent materials in order to raise the color temperature, i.e., to generate bluish white light and the numbers of the discharge pulses for all the fluorescent materials are increased to improve the brightness. As a result, the inventors have found that the deterioration of the blue fluorescent material is more rapid than those of other fluorescent materials and the color temperature is lowered in a several hundreds of hours.

FIG. 9 shows a reduction in the color temperature with respect to cumulative elapsed driven time of the PDP in an x-y chromaticity diagram. In FIG. 9, reference numeral 200 denotes an initial value of the color temperature; 201 denotes a color temperature after 120 hours; 202 denotes a color temperature after 144 hours; 203 denotes a color temperature after 168 hours; 204 denotes a color temperature after 192 hours; 205 denotes a color temperature after 312 hours; 206 denotes a color temperature after 360 hours; 207 denotes a color temperature after 432 hours; 208 denotes a color temperature after 528 hours; 209 denotes a color temperature after 696 hours; 210 denotes a color temperature after 936 hours; 211 denotes a color temperature after 1,200 hours; 212 denotes a color temperature after 1,320 hours; 213 denotes a color temperature after 1,464 hours; 214 denotes a color temperature after 1,632 hours; and 215 denotes a color temperature after 1,800 hours.

The initial color temperature denoted by reference numeral 200 is about 10,000 [K], and the color temperature is lowered due to non-uniform deterioration of the fluorescent materials to about 8,300 [K] as denoted by reference numeral 208 (after 528 hours) and then to about 7,400 [K] as denoted by reference numeral 215 (after 1,800 hours). The initial color temperature is set to about 10,000 [K], which is similar to the color temperature of the cathode ray tube, as denoted by reference numeral 200, and the number of discharge pulses is increased and the discharge period is lengthened to improve the brightness. It is considered that, as a result of increasing the numbers of discharge pulses, the deterioration of the blue fluorescent material is more rapid than those of the red and green fluorescent materials and the deterioration accelerates the reduction in the color temperature.

An object of the present invention is to provide a plasma display panel display device capable of solving the above problems and improving a reduction in a color temperature caused by a cumulative elapsed driven time of a plasma display panel.

In order to solve the above problems, according to an aspect of the present invention, there is provided a plasma display panel display device for displaying images by using the subfield method to cause a plurality of types of electrodes that are provided with different fluorescent substances to discharge, comprising measuring means for measuring a cumulative discharge time of the plasma display panel display device and controlling means for controlling the number of display pulses, wherein the number of display pulses relevant for at least one of fluorescent substances is changeably controlled on the basis of the cumulative discharge time measured by the measuring means.

DETAILED DESCRIPTION OF PREFERRED EMBODIMENTS

Figure 1:
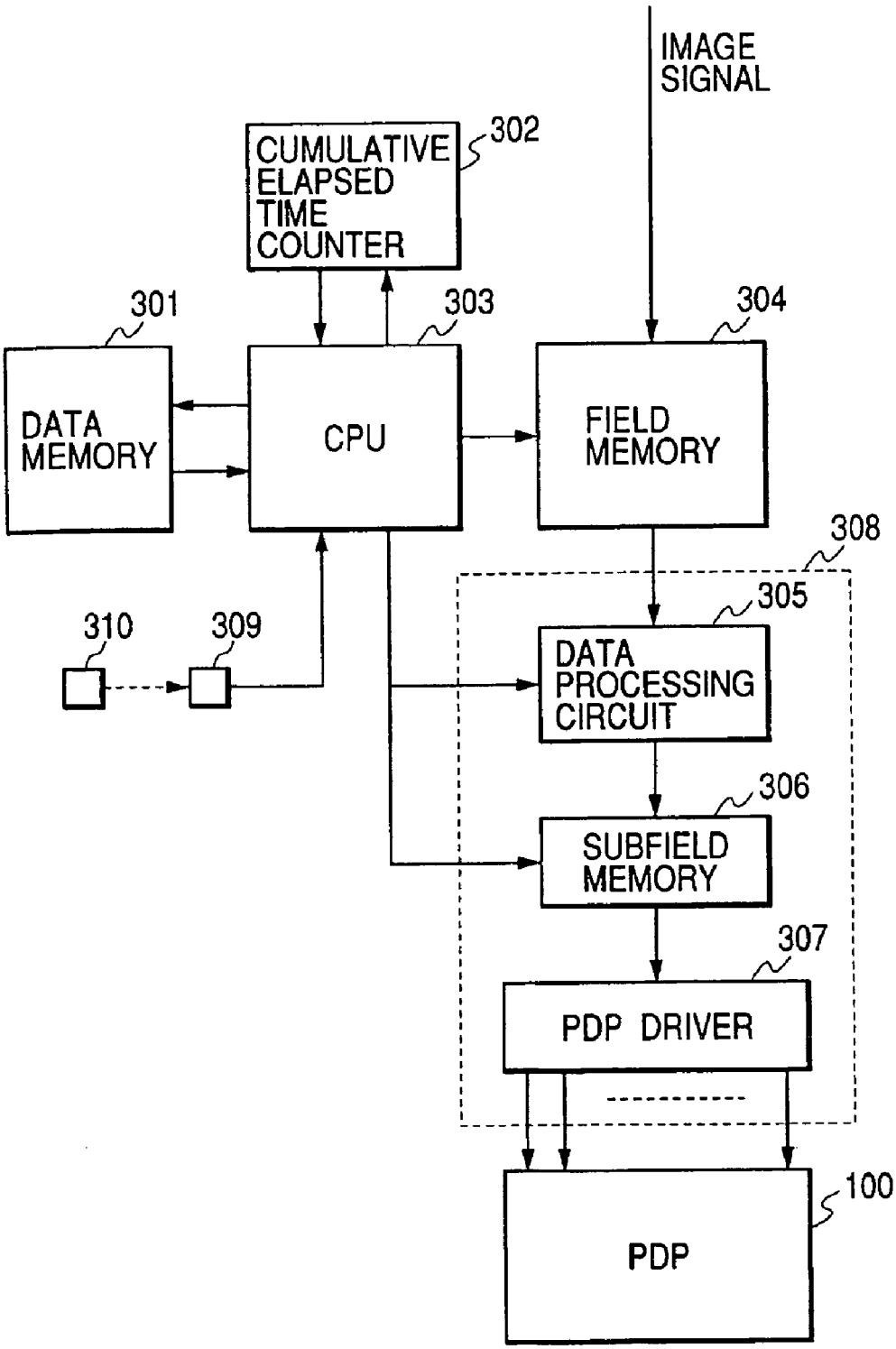
FIG. 1 is a block diagram of a PDP display device according to an embodiment of the present invention.

Preferred embodiments of the present invention will be described below in detail with reference to the accompanying drawings.

In the first place, physical meanings of setting a color temperature will be explained.

Generally, a color (F) can be represented by the following expression (Expression 1), by using (R), (G) and (B) as unit vectors of primary color light emitted from fluorescent materials R, G and B that are used in the PDP. In the expression, the R, G and B are coefficients, and (Expression 2) is established among the unit vectors of primary color light.

$$(F)=R(R)+G(G)+B(B) \quad \text{(Expression 1)}$$

$$(C)=(R)+(G)+(B) \quad \text{(Expression 2)}$$

wherein, (C) is a standard white of a predetermined color temperature.

In the PDP display device, the unit vectors of primary colors (R), (G) and (B) are firstly set to generate white having the predetermined temperature. This is equal to the fact that, in the case of using analog signals, (R), (G) and (B) are so set to generate white having the predetermined color temperature by inputting R, G and B image signals of predetermined levels and adjusting gains of image amplifiers (not shown) of the R, G and B.

In the case of using digital image signals, white having the predetermined color temperature is generated by setting one of R, G and B to a value with a predetermined margin with respect to a maximum gradation value (the maximum gradation value is 255 in the case of 8 bit gradation) in a driving circuit (not shown) for display devices, taking deterioration of a relevant fluorescent material into consideration and then adjusting other two colors. In the following description, the R, G and B adjusted to generate white having the predetermined color temperature will be referred to as "color temperature value R", "color temperature value G" and "color temperature value B" for the sake of convenience.

After the above operation, the coefficients R, G and B of Expression 1 are processed in accordance with the image signals to drive the PDP, so that the coefficients are in a range of 0 to 1 in the case of the analog image signals or in a range of 0 to 255 in the case of the digital image signals. That is to say, in the case where the digital image signals are used, an arbitrary color is displayed by the unit of the color temperature values R, G and B.

The embodiments of the present invention will be described below.

According to the present invention, in order to suppress a reduction in color temperature due to cumulative elapsed driven time of a PDP, an arithmetic and control means such as a microcomputer (hereinafter abbreviated to "CPU") controls the number of discharge pulses for exciting a blue fluorescent material and the numbers of discharge pulses for exciting red and green fluorescent materials, so that each of the color temperature values R, G and B is usable as a value for correcting the reduction in color temperature due to the cumulative elapsed driven time of the PDP. Thus, it is possible to suppress the reduction in color temperature otherwise caused by the deterioration of the fluorescent materials and maintain excellent quality of images.

Two representative methods for controlling the number of discharge pulses will be described with reference to FIGS. 2A to 2C.

Figure 2A:
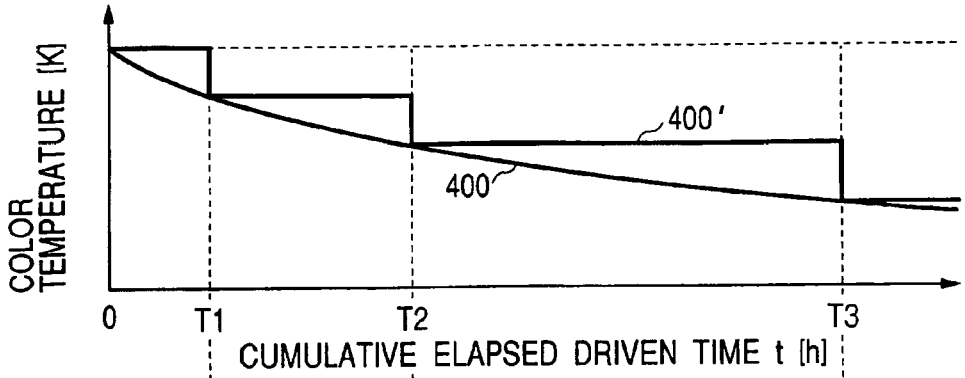
FIG. 2A is a graph showing a color temperature reduction curve with respect to cumulative elapsed driven time of a PDP.
Figure 2B:
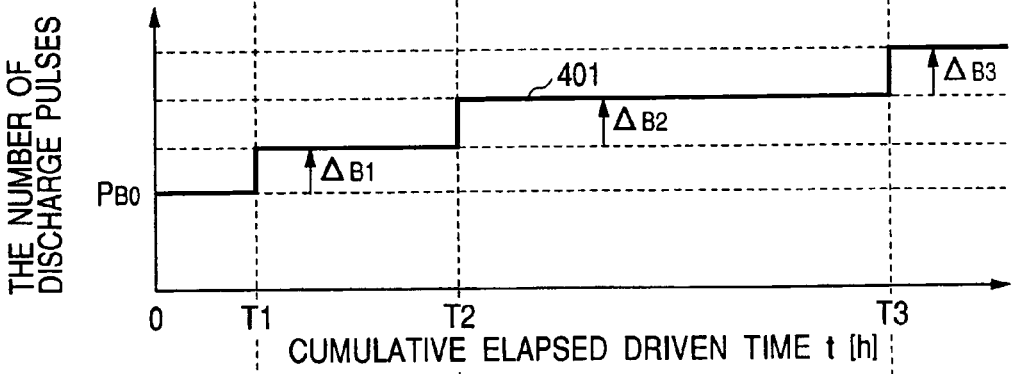
FIGS. 2B and 2C are graphs each showing a discharge pulse number correction curve with respect to the cumulative elapsed driven time of the PDP.

FIG. 2A shows changes in color temperature with respect to cumulative elapsed driven time of the PDP, and FIG. 2B shows a correction curve for the number of discharge pulse for a blue fluorescent material used for correcting deterioration in brightness of the blue primary color unit (B). The reduction in color temperature is due primarily to the deterioration of the blue fluorescent material and, therefore, only the number of discharge pulses for blue fluorescent material is increased to correct the reduction. FIG. 2C is a correction curve for the numbers of discharge pulses for red and green fluorescent materials used for reducing and correcting emission brightness of red and green fluorescent materials, i.e., the brightness of the red and green primary color units (R) and (G) in accordance with the deterioration of the blue fluorescent material without changing the number of discharge pulses for blue fluorescent material. Changes in the brightness are suppressed in the method of FIG. 2B, while the brightness is reduced in the method of FIG. 2C.

In FIG. 2A, reference numeral 400 denotes a curve indicating changes and reduction with time in color temperature; 400' denotes an approximation curve indicating changes and reduction with time in color temperature obtained by dividing the cumulative elapsed driven time along the horizontal axis of the curve 400 into a plurality of sections (0, T1, T2, T3) and approximating the sections by way of stepwise changes. Hereafter, the correction of a reduction in color temperature will be described using the curve 400'.

In FIG. 2B, reference numeral 401 denotes a curve for correcting the number of pulses for blue fluorescent material used for correcting the deterioration in brightness in the unit vector of blue primary color light (B) emitted from the blue fluorescent material, wherein the horizontal axis indicates the cumulative elapsed driven time and the vertical axis indicates increments in the discharge pulses in accordance with the reduction in color temperature used for the correction. An increment in the discharge pulses for blue fluorescent material in the cumulative elapsed driven time T1 to T2 is indicated by $\Delta_{B1}$; an increment in the discharge pulses for blue fluorescent material in the cumulative elapsed driven time T2 to T3 is indicated by $\Delta_{B2}$; and an increment in the discharge pulses for blue fluorescent material in the cumulative elapsed driven time after T3 is indicated by $\Delta_{B3}$.

Figure 2C:
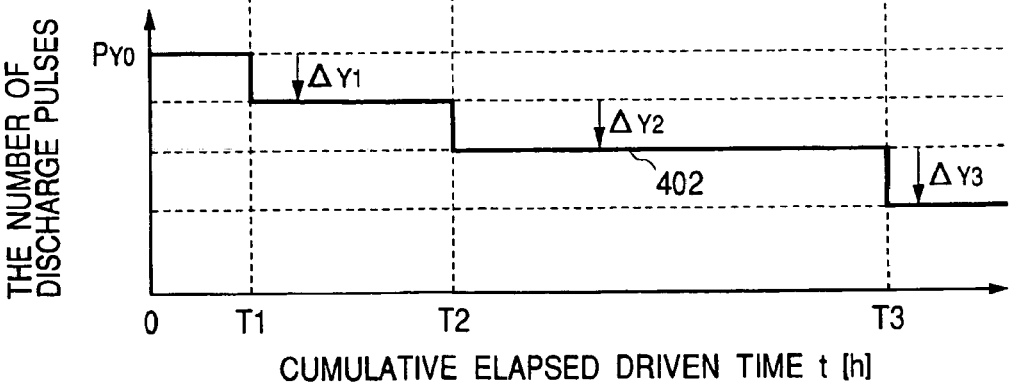

In FIG. 2C, reference numeral 402 denotes a correction curve for the numbers of pulses for red and green fluorescent materials that is used for correcting the deterioration in brightness by reducing the emission brightness of red and green fluorescent materials, i.e., the brightness of red and green primary color units (R) and (G) in accordance with the deterioration of the blue fluorescent material, wherein the horizontal axis indicates the cumulative elapsed driven time and the vertical axis indicates decrements in the number of discharge pulses in accordance with the reduction in color temperature that are used for the correction. The decrement in each of the numbers of discharge pulses for the red and green fluorescent materials in the cumulative elapsed driven time T1 to T2 is indicated by $\Delta_{Y1}$ (Y: R, G); the decrement in each of the numbers of discharge pulses for red and green fluorescent materials in the cumulative elapsed driven time T2 to T3 is indicated by $\Delta_{Y2}$ (Y: R, G); and the decrement in each of the numbers of discharge pulses for red and green fluorescent materials in the cumulative elapsed driven time after T3 is indicated by $\Delta_{Y3}$ (Y: R, G). Both the red and green fluorescent materials are deteriorated with the cumulative elapsed driven time; however, the actual amounts of deterioration are ignored since they are less than the amount of deterioration of the blue fluorescent material, and the numbers of discharge pulses for the red and green fluorescent materials are reduced for the correction equally to each other.

Since a reduction rate of the color temperature is high in the case where the cumulative elapsed driven time of the PDP from the start of discharge is short (for example, in 500 hours from the start of discharge) as is apparent from FIG. 2A, each of the corrections for fluorescent materials is so set to be performed on the short interval basis in accordance with each of the amounts of deterioration in brightness of the fluorescent materials as shown in FIGS. 2B and 2C. In turn, since a reduction rate of the color temperature is low in the case where the cumulative elapsed driven time of PDP is long (for example, 1,000 hours or more from the start of discharge), a time interval for setting the number of discharge pulses for each of the fluorescent materials for the correction is lengthened in accordance with the reduction rate of color temperature. In addition, although the cumulative elapsed driven time is divided into four sections in FIGS. 2A to 2C, it is obvious that the present invention is not limited to the time intervals shown in FIGS. 2A to 2C.

FIG. 1 is a block diagram showing a configuration of a PDP display device according to one embodiment of the present invention.

In FIG. 1, reference numeral 303 denotes a CPU that is arithmetic and control means, and 302 denotes a cumulative elapsed time counter for measuring cumulative elapsed driven time of a PDP driving circuit. Reference numeral 301 denotes a data memory for storing: a predetermined amount of change $\Delta_{X1}$ (X: R, G, B) in each of the numbers of discharge pulses by the primary color unit of the fluorescent materials that is equal to each of the color temperature values R, G and B that indicates brightness of each of the unit vectors of primary color light (R), (G) and (B) emitted from the fluorescent materials, the amounts of changes being used for correcting the reduction in color temperature with the cumulative elapsed driven time of PDP in each of intervals ($T_i$–$T_{i+1}$) of the cumulative elapsed driven time as shown in FIGS. 2A to 2C; a predetermined start time $T_i$ for each of the intervals; and a correction flag $F_i$, which is provided in each of the intervals to indicate whether or not the amount of change in any one of the numbers of discharge pulses in each of the intervals is used in a previous correction for calculating the number of discharge pulses for the correction of color temperature. The data memory 301 stores the data, the start time and the correction flag for each of the intervals that are shown in FIGS. 2B and 2C, for example. Further, in addition to the above data, the data memory 301 stores the numbers of discharge pulses for the fluorescent materials by the primary color unit at the time of the previous correction in order to calculate current numbers of discharge pulses at the time of setting the number of discharge pulses from the amount of change in the number of discharge pulses used for the previous correction. Reference numeral 308 denotes a driving circuit for displaying digital image signals on the PDP 100 as being controlled by the CPU 303. Reference numeral 310 denotes an infrared rays generating device such as a remote controller for generating infrared rays to be used for operating the PDP display device; and 309 denotes a light reception section for receiving infrared ray-signals transmitted from the infrared rays generating device 310. Reference numeral 304 denotes a field memory that stores field data by the unit of pixel that indicates brightness levels of red, green and blue of digital image signals transmitted from an external device such as a TV tuner and transmits the field data to the driving circuit 308.

The driving circuit 308 includes a data processing circuit 305, a subfield memory 306 and a PDP driver 307. The data processing circuit 305 is data converting means for determining the number of discharge pulses for each of the three colors per field by the unit of numbers of discharge pulses $P_{xi}$ (X: R, G, B) that are calculated from the data for amounts of changes in the numbers of discharge pulses for the fluorescent materials and the numbers of discharge pulses for the fluorescent materials by the primary color unit in the previous correction, both the data and the numbers of discharge pulses used for the calculation being stored in the data memory 301; dividing one field into the predetermined number of subfields; and converting the decided number of discharge pulses into subfield data indicating emission/non-emission of each of the subfields. The data processing circuit 305 outputs the subfield data in accordance with the field data. The subfield data are stored in the subfield memory 306, and the PDP driver 307 reads out required subfield data from the subfield memory 306 to drive the PDP 100.

Assuming that current numbers of discharge pulses are $P_{xi}$ (X: R, G, B) and a gradation value of an arbitrary pixel in the field memory 304 is $N_j$, the numbers of discharge pulses $P_{XNj}$ (X: R, G, B) for the arbitrary pixel to be converted by the data processing circuit 305 are represented by the following (Expression 3):

$$P_{XNj}=P_{Xi}\times N_j/255 \quad \text{(Expression 3).}$$

wherein, 255 is a maximum gradation value in 8-bit gradation.

The CPU 303 controls a series of operations of: calculating the current numbers of discharge pulses $P_{Xi}$ from the amounts of changes $\Delta_{Xi}$ in the numbers of discharge pulses for the fluorescent materials that are stored in the data memory 301 to be used for correcting the reduction in color temperature and the numbers of discharge pulses $P_{Xi-1}$ for the fluorescent materials by the primary color unit at the time of the previous setting; calculating the numbers of discharge pulses of the field data stored in the field memory 304 from the Expression 3 by the unit of $P_{Xi}$ in the driving circuit 308 to convert the field data into the subfield data and store the obtained subfield data in the subfield memory 306; and reading out the subfield data as required to be displayed by driving the PDP 100 using the PDP driver.

A color temperature correction processing for correcting the reduction in color temperature by increasing and decreasing the numbers of discharge pulses in the PDP will be described with reference to the block diagram of the PDP display device shown in FIG. 1 and the attached flowcharts.

Figure 3:
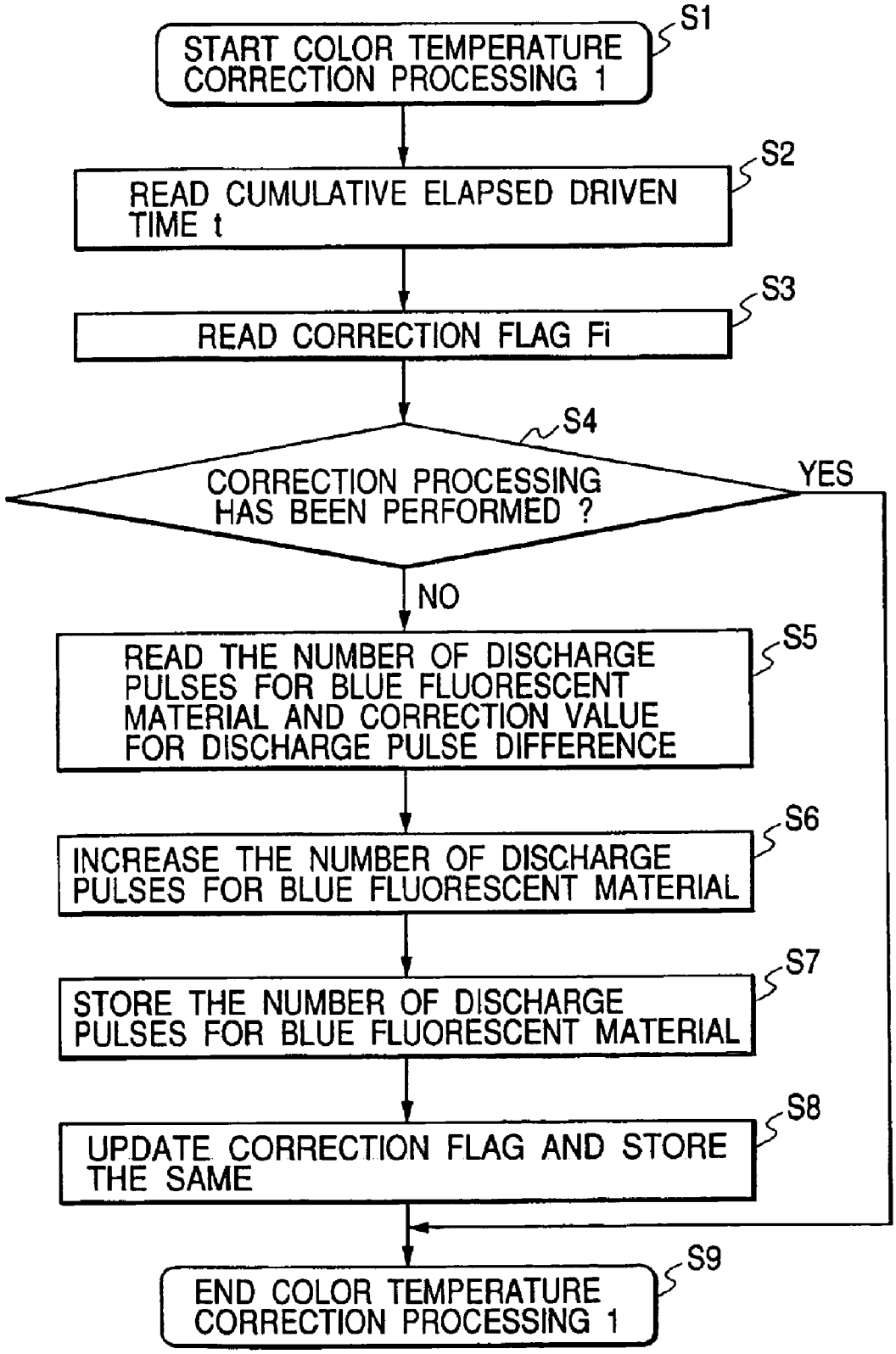
FIG. 3 is a flowchart for a process of increasing the number of discharge pulses for a blue fluorescent material at the time of activating the PDP.
Figure 4:
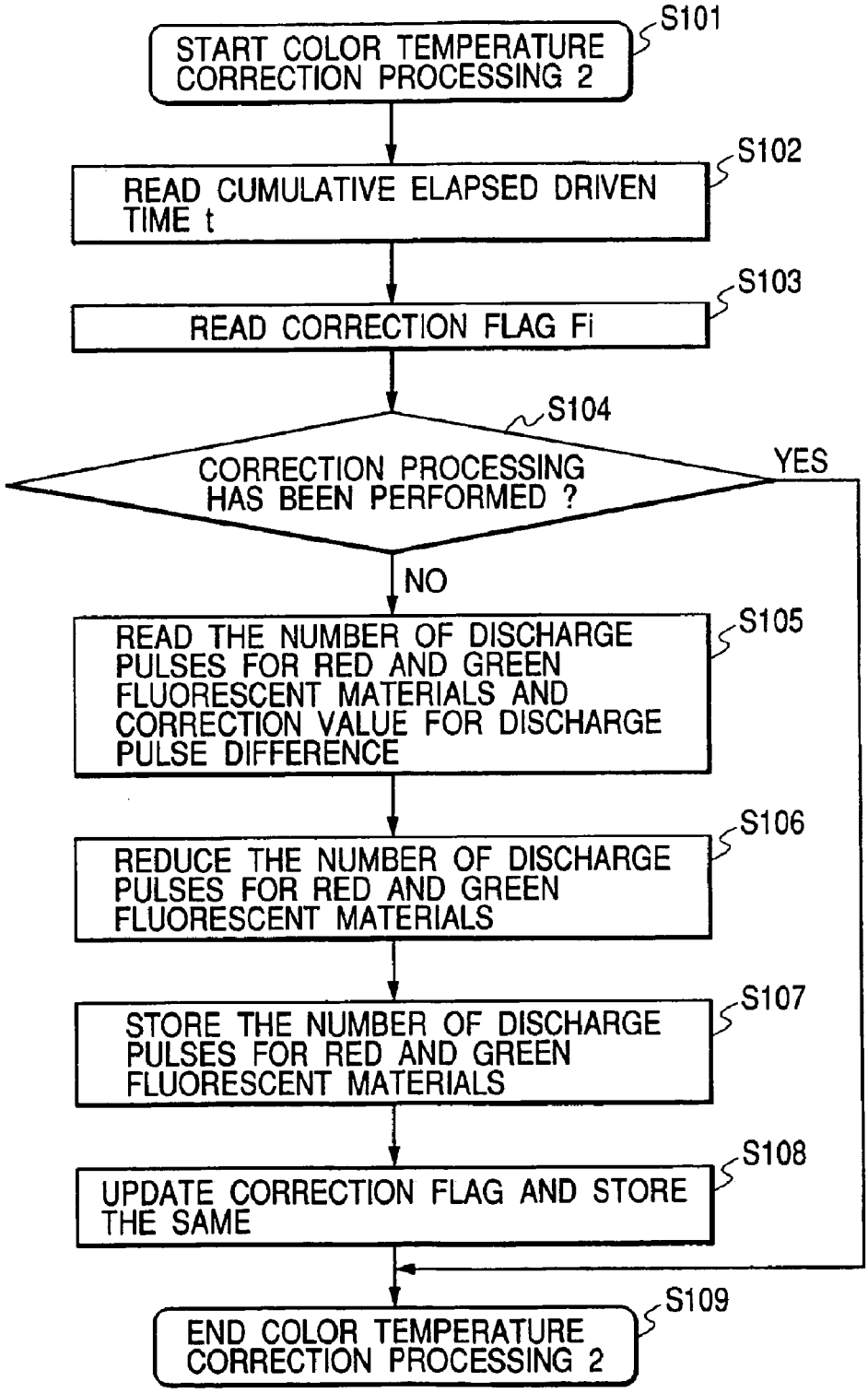
FIG. 4 is a flowchart for a process of decreasing the numbers of pulses for red and green fluorescent materials at the time of activating the PDP.
Figure 5:
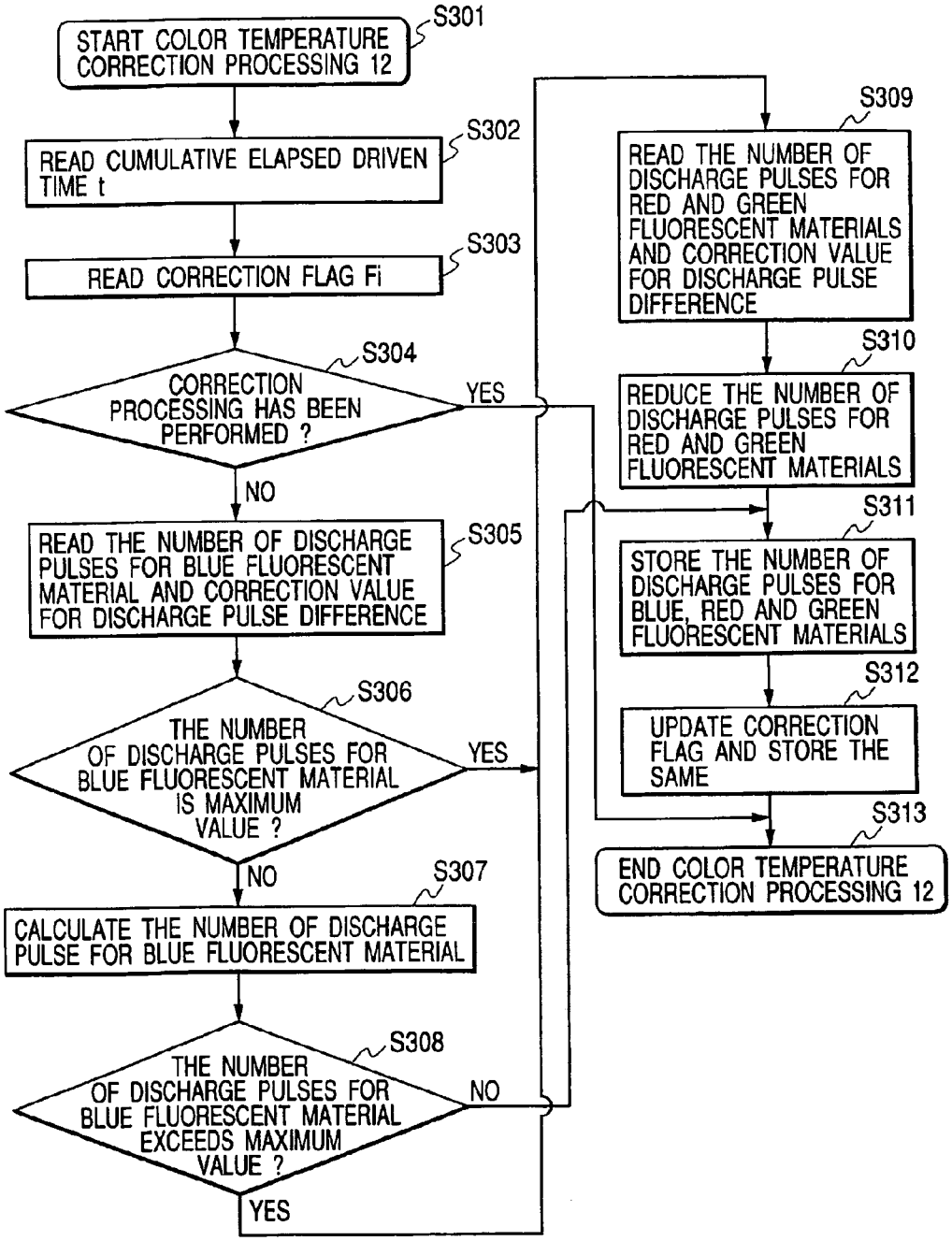
FIG. 5 is a flowchart for a process of increasing and decreasing the number of discharge pulses for the fluorescent materials at the time of activating the PDP.

FIGS. 3 to 5 are the flowcharts each showing a process for controlling the number of discharge pulses by changing an amount of correction for the reduction in color temperature depending on the cumulative elapsed driven time of the PDP at the time of activating the PDP.

FIG. 3 is a flowchart showing a process of increasing the number of discharge pulses for blue fluorescent material depending on an amount of reduction in color temperature at the time of activating the PDP. When the PDP is activated, color temperature correction processing 1 is started in Step 1 (hereinafter, the Step is abbreviated to "S"). The CPU 303 reads out a cumulative elapsed driven time t of PDP from the cumulative elapsed time counter 302 in S2, and determines to which one of the intervals $(T_i-T_{i+1})$ shown in FIG. 2B the cumulative elapsed driven time t belongs. Next, in S3, the CPU 303 reads out a correction flag $F_i$ of the relevant interval $(T_i-T_{i+1})$ stored in the data memory 301. The correction flag $F_i$ indicates whether or not increment data of the number of discharge pulses of the relevant interval has been used in the previous color temperature correction processing and, for example, "1" is written in the flag when the data has been used. In the case where "1" is written, it indicates that the cumulative elapsed driven time t belonged to the same interval $(T_i-T_{i+1})$ in the previous color temperature correction processing, and the reduction in color temperature has already been corrected using the increment in the number of pulses in the interval. In S4, the correction flag $F_i$ is checked, and, if the flag $F_i$ indicates that the correction has been performed, the color temperature correction processing 1 is brought to an end in S9. If the correction has not been performed, the increment $\Delta_{Bi}$ in the number of discharge pulses for blue fluorescent material in the relevant interval $(T_i-T_{i+1})$ and the number of discharge pulses for blue fluorescent material $P_{Bi-1}$ written in the previous color temperature correction processing are read out from the data memory 301 in S5. Then, in S6, an updated number of discharge pulses $P_{Bi}$ for blue fluorescent material is calculated by using the Expression 4 to supply the discharge pulses to the driving circuit 308, thereby performing display driving of the PDP 100.

$$P_{Bi}=P_{Bi-1}+\Delta_{Bi} \quad \text{(Expression 4).}$$

In S7, the number of discharge pulses $P_{Bi}$ of blue fluorescent material corrected in the current correction processing is written in the data memory to substitute the number of discharge pulses for blue fluorescent material $P_{Bi-1}$ set in the previous correction processing, while, in S8, the correction flag relevant to the interval $(T_i-T_{i+1})$ of the data memory 301 is set to 1 so as to indicate that the number of discharge pulses is corrected in the interval $(T_i-T_{i+1})$. After that, the color temperature correction processing 1 is brought to an end (S9).

The increase in the number of discharge pulses for blue fluorescent material in accordance with the discharge pulse correction curve results in an increase in brightness of the blue fluorescent material in an amount that is the same as the amount of brightness reduced due to the deterioration in discharge, thereby achieving an effect of recovering the color temperature to the initial value.

FIG. 4 is a flowchart showing a process of decreasing the numbers of discharge pulses for red and green fluorescent materials in accordance with reduction in color temperature at the time of driving the PDP. As is the case with the process shown in FIG. 3, it is assumed that the primary factor for the reduction in color temperature is the deterioration of blue fluorescent material. While the reduction in color temperature is corrected by increasing the number of discharge pulses for blue fluorescent material in FIG. 3, the numbers of discharge pulses for red and green fluorescent materials are decreased for the correction without changing the number of discharge pulses for blue fluorescent material in FIG. 4.

When the PDP is activated, color temperature correction processing 2 is started in S101. The CPU 303 reads out a cumulative elapsed driven time t of the PDP from the cumulative elapsed time counter 302 in S102, and determines to which one of the intervals $(T_i-T_{i+1})$ shown in FIG. 2C the cumulative elapsed driven time t belongs. Next, in S103, a correction flag $F_i$ of the relevant interval $(T_i-T_{i+1})$ stored in the data memory 301 is read out. In S104, the correction flag $F_i$ is checked, and, if it is indicated that the correction has been performed, the color temperature correction processing 2 is brought to an end in S109. If the correction has not been performed, the decrement $\Delta_{Yi}$ (Y: R, G) in the numbers of discharge pulses for red and green fluorescent materials in the relevant interval ($T_i$–$T_{i+1}$) and the numbers of discharge pulses for red and green fluorescent materials $P_{Yi-1}$ (Y: R, G) written in the previous color temperature correction processing are read out from the data memory 301 in S105. Then, in S106, the updated numbers of discharge pulses for red and green fluorescent materials $P_{Yi}$ (Y: R, G) are calculated by using the Expressions 5 and 6 to supply the updated discharge pulses to the driving circuit 308, thereby performing display driving of the PDP 100.

$$P_{Ri}=P_{Ri-1}-\Delta_{Ri} \quad \text{(Expression 5)}$$

$$P_{Gi}=P_{Gi-1}-\Delta_{Gi} \quad \text{(Expression 6)}$$

In S107, the numbers of discharge pulses for red and green fluorescent materials $P_{Yi}$ corrected in the current correction processing are written in the data memory 301 to substitute the numbers of discharge pulses for red and green fluorescent materials $P_{Yi-1}$ set in the previous correction processing, while, in S108, the correction flag relevant to the interval ($T_i$–$T_{i+1}$) of the data memory 301 is set to "1" so as to indicate that the numbers of discharge pulses are corrected in the interval ($T_i$–$T_{i+1}$) After that, the color temperature correction processing 2 is brought to an end (S109). Thus, an effect similar to that achieved by the process shown in FIG. 3 is achieved by decreasing the numbers of discharge pulses for red and green fluorescent materials as described above; however, the brightness is inevitably decreased at the same time due to the decrease in the numbers of discharge pulses.

FIG. 5 shows a flowchart that is a combination of the color temperature correction processing 1 shown in FIG. 3 and the color temperature correction processing 2 shown in FIG. 4, the flowchart showing a process of changing the numbers of discharge pulses for three color fluorescent materials at the time of activating PDP. It is assumed that the number of discharge pulses for blue fluorescent material does not exceed a maximum gradation value (for example, 255 in the case of 8 bit gradation) in the process shown in FIG. 3; however, in some cases, even if a predetermined number of discharge pulses is decided in view of the reduction in color temperature, the number of discharge pulses for blue fluorescent material after the correction may exceed the maximum gradation value due to changes with time in the color temperature depending on the type of blue fluorescent material. FIG. 5 shows a flow of a process that copes with such cases as mentioned above. In the process, the number of discharge pulses for blue fluorescent material is fixed to the maximum gradation value in the case where the number of discharge pulses for blue fluorescent material exceeds the maximum gradation value and then the numbers of discharge pulses for red and green fluorescent materials are decreased. The process will be described below in detail with reference to FIG. 5.

At the time of activating the PDP, a color temperature correction processing 12 is started in S301. The CPU 303 reads out cumulative elapsed driven time t of the PDP from the cumulative elapsed time counter 302 in S302, and determines to which one of the intervals ($T_i$–$T_{i+1}$) shown in FIG. 2B the cumulative elapsed driven time t belongs. Next, in S303, a correction flag $F_i$ of the relevant interval ($T_i$–$T_{i+1}$) stored in the data memory 301 is read out. In S304, the correction flag $F_i$ is checked, and, if the number of discharge pulses has been corrected, the color temperature correction processing 12 is brought to an end in S313. In the case where the number of discharge pulses has not been corrected, an increment $\Delta_{Bi}$ of the number of discharge pulses for blue fluorescent material of the relevant interval ($T_i$–$T_{i+1}$) and the number of pulses for blue fluorescent material $P_{Bi-1}$ written at the time of the previous color temperature correction processing are read out from the data memory 301 in S305. Then, in S306, it is determined whether or not the number of discharge pulses $P_{Bi-1}$ read out in S305 is the maximum gradation value. If the number of discharge pulses $P_{Bi-1}$ is the maximum value, the process proceeds to S309, while the process proceeds to S307 if the number of discharge pulses $P_{Bi-1}$ is not the maximum value.

If the number of discharge pulses $P_{Bi-1}$ is not the maximum value in S306, the new number of discharge pulses for blue fluorescent material is calculated by using the Expression 4 in S307.

In the case where it is detected that the number of discharge pulses $P_{Bi-1}$ calculated in S307 is not more than the maximum value in S308, the value is supplied to the driving circuit 308 to perform a display driving of the PDP 100, and the process proceeds to S311. If the number of discharge pulses $P_{Bi}$ for blue fluorescent material exceeds the maximum gradation value, the maximum gradation value is set as the number of discharge pulses $P_{Bi}$ in the driving circuit 308 and the process proceeds to S309.

In S309 and S310, the reduction in color temperature cannot be corrected by increasing the number of discharge pulses for blue fluorescent material ($P_{Bi}$ is set as the maximum gradation value) and, therefore, the correction is performed by decreasing the numbers of discharge pulses for red and green fluorescent materials. Since the amounts of correction are indicated by the decrements as shown in the discharge pulse correction curve for red and green fluorescent materials of FIG. 2C, the numbers of discharge pulses for red and green fluorescent materials $P_{Yi-1}$ (Y: R, G) in the previous color temperature correction processing and decrement $\Delta_{Yi}$ are read out in S309. Then, in S310, the new numbers of discharge pulses $P_{Yj}$ for red and green fluorescent materials is calculated using the Expression 1 and Expression 2 to be supplied to the driving circuit 308, thereby performing display driving of the PDP 100. If the $P_{Bi}$ exceeds the maximum gradation value in S308, $\Delta_{Ri}$ and $\Delta_{Gi}$ in the Expression 5 and Expression 6 are substituted by a value obtained by multiplying an amount of the excess $\Delta_{BiOVER}$ by a predetermined coefficient to calculate the new numbers of discharge pulses.

In S311, the numbers of pulses $P_{Bi}$, $P_{Ri}$ and $P_{Gi}$ that are currently corrected replace the numbers of discharge pulses stored in the previous color temperature correction processing in the data memory 301 to be stored therein, and, in S312, the correction flag $F_i$ relevant to the interval ($T_i$–$T_{i+1}$) in the data memory 301 is changed to be "1" in order to indicate that the numbers of discharge pulses are corrected in the interval ($T_i$–$T_{i+1}$). Then, the color temperature correction processing 12 is brought to an end (S313).

The color temperature correction processing described above are performed at the time of activating the PDP display device; however, the timing for the correction is not limited thereto, and it is possible to perform the correction at predetermined intervals such as every 50 hours. The correction of every 50 hours can be realized by a simple modification in the flow of processes described above and, therefore, the description of the correction is omitted in this specification.

Further, in a PDP display device that can set a plurality of color temperatures, the deterioration of fluorescent materials is accelerated if the color temperature is set to a relatively high value, such as 10,000 [K] and, therefore, it is possible to correct the reduction in color temperature by changing the settings of the color temperatures. In the case where the color temperature is set to be a relatively low value, such as 3,500 [K], the deterioration is so small and, therefore, the process can be so modified not to perform the color temperature correction. Since the modifications are so simple, the descriptions for which are omitted in this specification.

Figure 6:
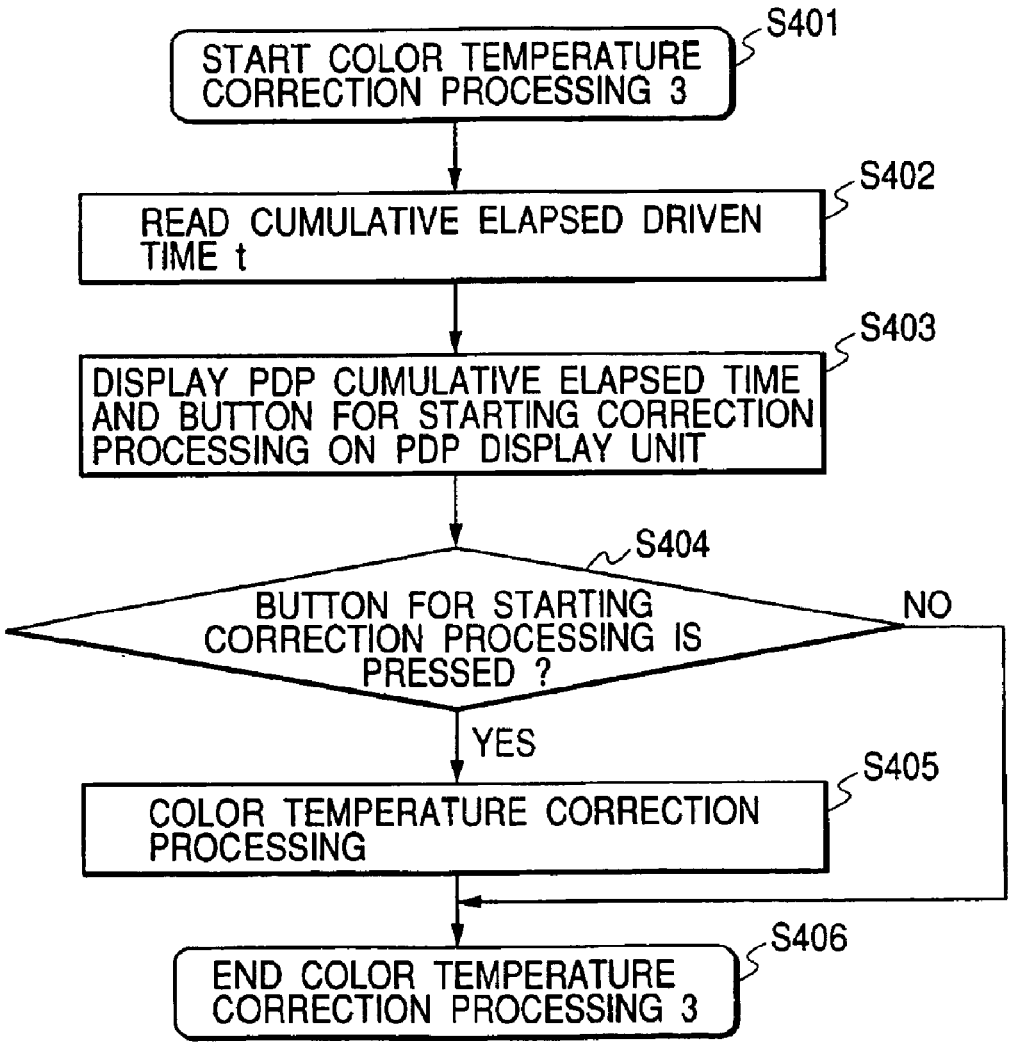
FIG. 6 is a flowchart for a process for performing a color temperature correction processing through external input.
Figure 7:
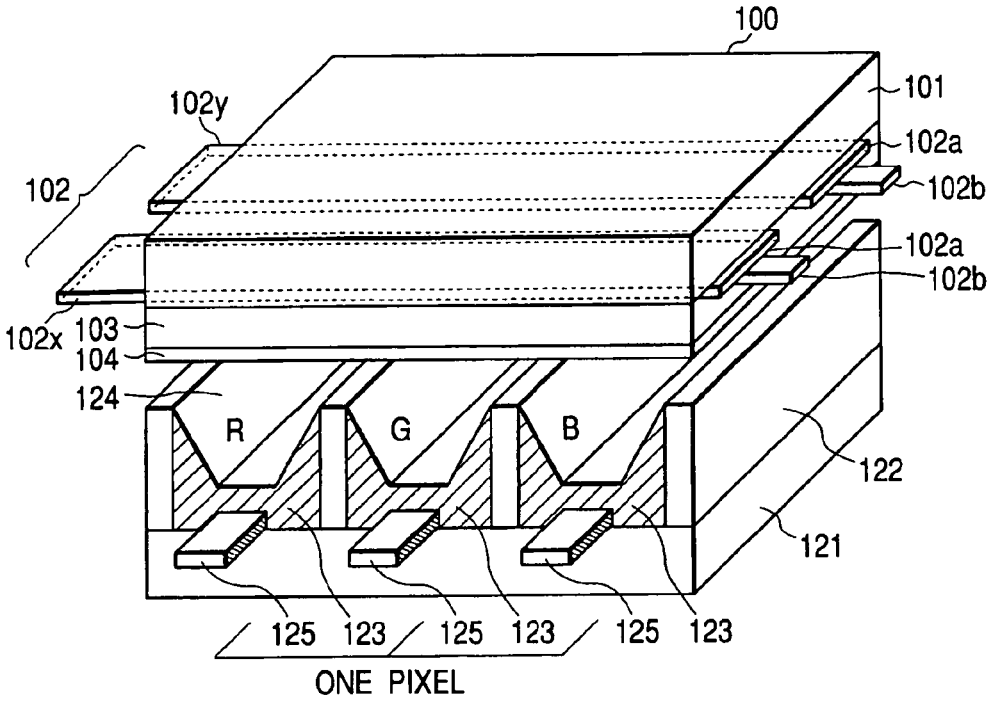
FIG. 7 is a perspective view showing an example of a panel configuration of an AC type PDP.
Figure 8:
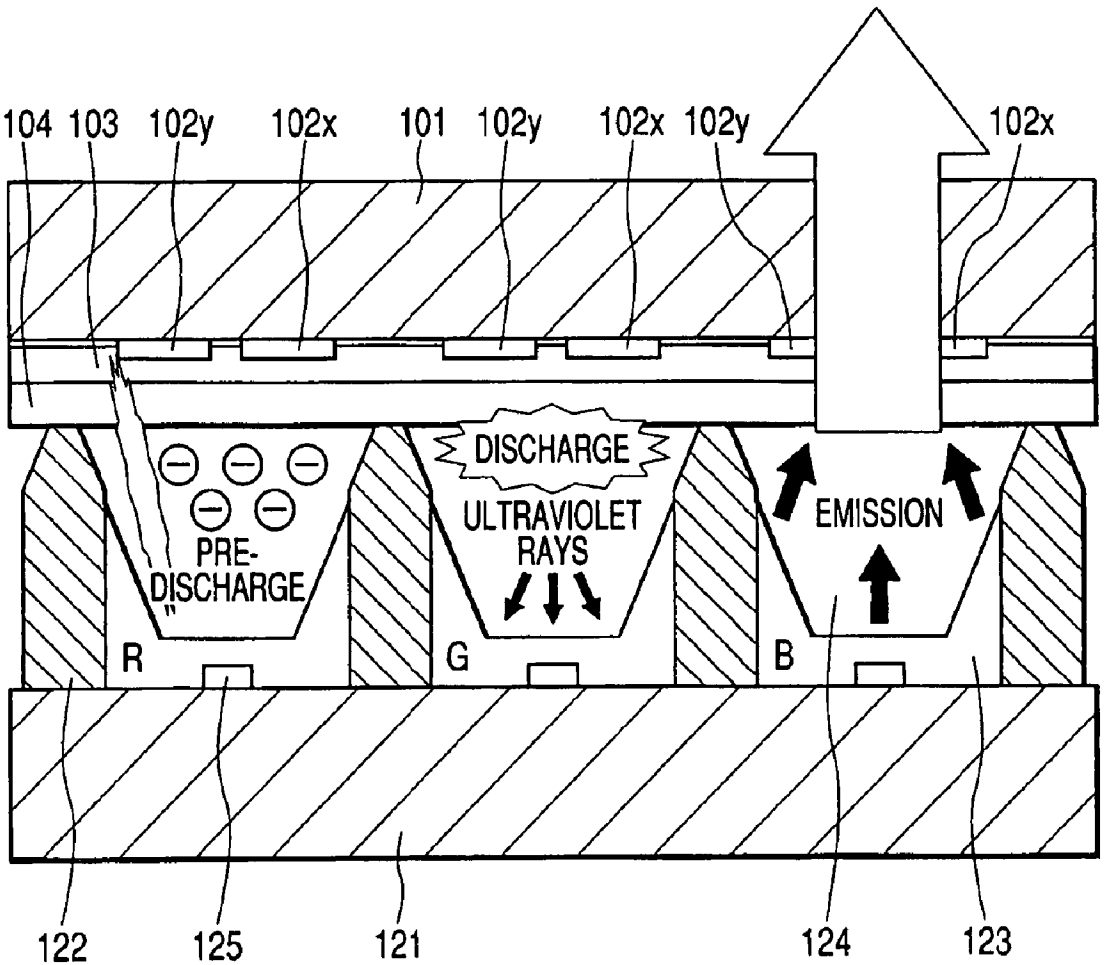
FIG. 8 is a schematic diagram showing a discharge mechanism of the PDP.
Figure 9:
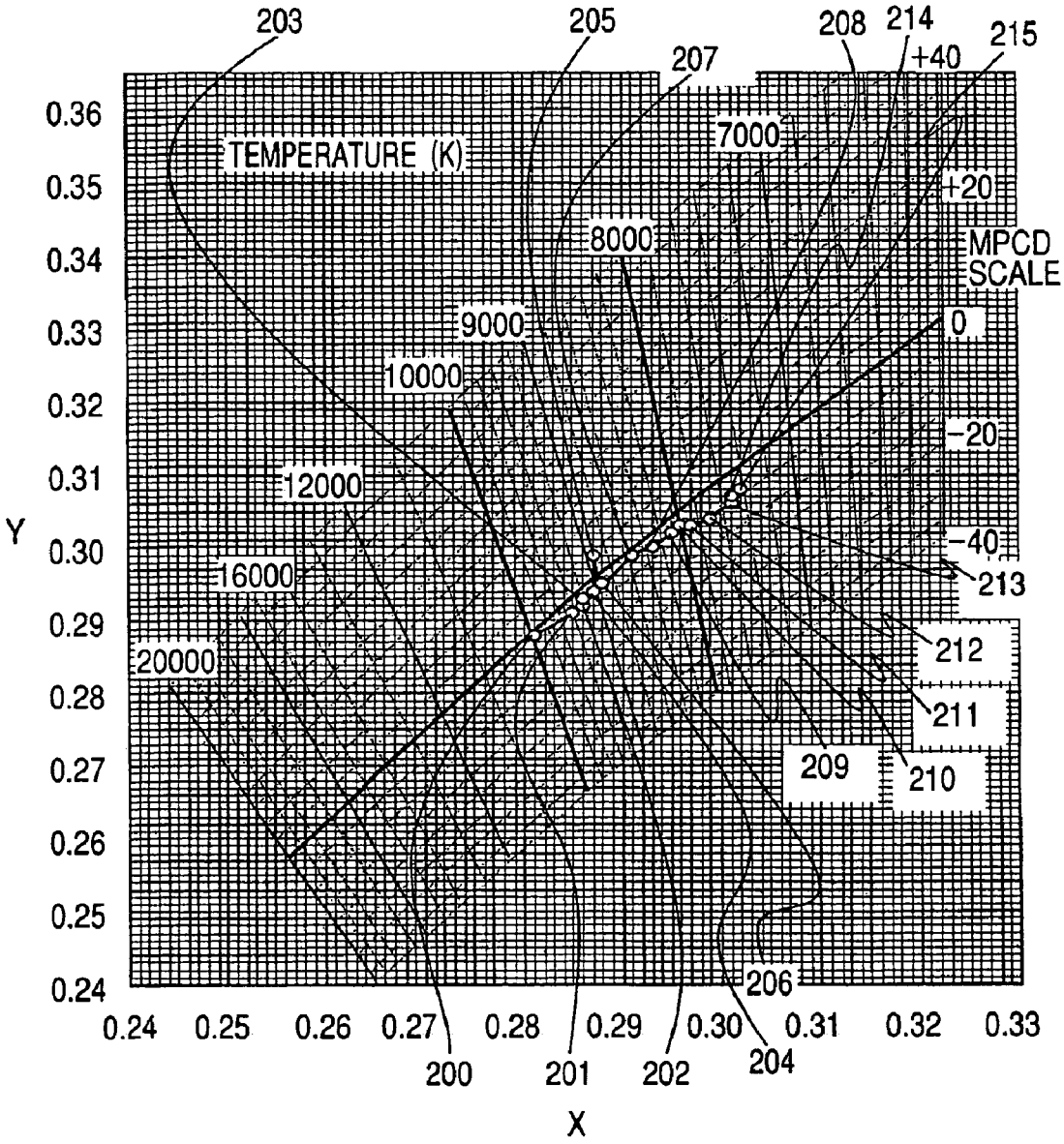
FIG. 9 is an x-y chromaticity diagram showing changes in color temperature.
Figure 10:
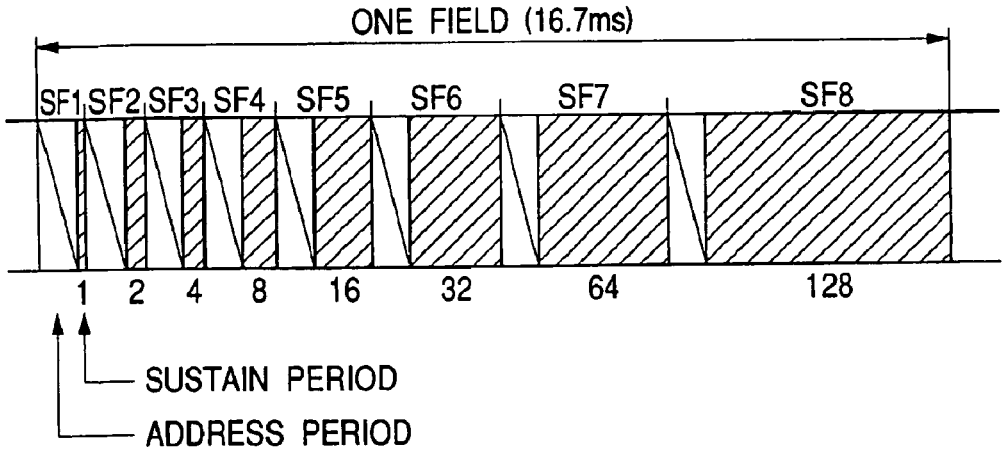
FIG. 10 is a diagram showing a display method of the PDP.

FIG. 6 shows a flowchart showing a color temperature correction performed through an external input. The correction of the number of discharge pulses is performed manually by a user using the infrared rays generating device 310 such as a remote controller, not by performing the correction at the time of activating the PDP or at the predetermined intervals as described above.

Color temperature correction processing 3 is started in S401. In S402, upon reception of operation of menu buttons on the infrared rays generating device 310, which is performed by the user, the CPU 303 reads out cumulative elapsed driven time t of the PDP from the cumulative elapsed time counter 302. Next, in S403, the following processing is performed: the cumulative elapsed driven time t that is read out in S402 is displayed on the PDP 100 and, at the same time, the CPU determines to which one of the intervals ($T_i$–$T_{i+1}$) shown in FIG. 2B or 2C the read out cumulative elapsed driven time t belongs; a correction flag $F_i$ relevant to the interval is checked to judge whether or not the color temperature has been corrected; a need for correction of the color temperature is indicated by displaying the cumulative elapsed driven time t with a predetermined display color in the case where the correction has not been performed; and then a button for setting the start of the color temperature correction is displayed on the PDP 100. By the above operation, it is possible to inform the user whether or not it is necessary to correct the color temperature for every cumulative elapsed driven time t. Then, in S404, the user is prompted either to press or not to press the color temperature correction start and setting button displayed on the PDP 100. If the user operation is not performed in a predetermined time, the process proceeds to S406 to bring the color temperature correction processing 3 to an end. If a cursor button (not shown) of the infrared rays generating device 310 is pressed to start the color temperature correction, the color temperature correction processing of any one of FIGS. 3 to 5 is performed in S405, and then the color temperature correction processing 3 is brought to an end (S406).

The above-described color temperature setting process can be applied to a display device using analog image signals by adjusting a width of amplification of image amplifiers for R, G and B; however, since it is generally difficult to display a halftone between emission and non-emission in the PDP as mentioned above, the subfield method is used for the purpose of displaying the halftone. That is to say, since the PDP employs the digital display method, the color temperature correction processing according to the present invention is suitable for digital signal processing in the PDP, and therefore, suitably used in the case of using IC for performing the digital signal processing. Further, when the TV/BS/CS digital broadcastings, wherein demodulated image signals are used as the digital signals, are developed in future, the color temperature correction processing of the present invention will be remarkably useful for such broadcastings.

As described above, according to the present invention, it is possible to suppress the reduction in color temperature, even when the color temperature and brightness of the PDP display device are approximated to those achieved by the cathode ray tube, by increasing and/or decreasing the numbers of discharge pulses for the fluorescent materials in accordance with the cumulative elapsed time.

As described in the preferred embodiments of the present invention, it is possible to provide the plasma display panel display device capable of maintaining the excellent quality of images by controlling the numbers of discharge pulses for fluorescent materials to be in conformity with the discharge pulse number correction curve that is set in accordance with the curve of change and reduction with time in color temperature with respect to the cumulative elapsed discharge time in order to suppress the reduction in color temperature otherwise caused by the deterioration of the fluorescent materials due to the cumulative elapsed discharge time of the PDP.

We claim:

1. A plasma display device having a plurality of groups of electrodes, each of which is provided with one of fluorescent materials different from one another, for displaying images by using a subfield method, the plasma display device comprising:

an accumulator which accumulates a discharge time of said plasma display device;

a controller which controls and decides a number of discharge pulses supplied to said electrodes on the basis of a correction curve for the number of discharge pulses corresponding to color temperature correction; and a data converter which converts the decided number of discharge pulses decided by the controller into subfield data;

wherein said number of discharge pulses of at least one of said groups of electrodes provided on with one of said fluorescent materials is controlled in accordance with said correction curve for the number of discharge pulses when an indicating signal concerning the color temperature correction is inputted, independently of an input signal.

2. The plasma display device according to claim 1, wherein each of said electrodes is provided with one of three types of fluorescent materials of red, blue and green, and wherein at least the number of discharge pulses supplied to an electrode provided with blue fluorescent material is changeably controlled on the basis of said discharge time.

3. The plasma display device according to claim 1, wherein each of said electrodes is provided with one of three types of fluorescent materials of red, blue and green, and wherein the number of discharge pulses supplied to electrodes each provided with red and green fluorescent materials are changeably controlled on the basis of said discharge time.

4. The plasma display device according to claim 1, further comprising a memory which stores data obtained based on said correction curve to be used to control the number of discharge pulses.

5. A plasma display device including a plasma display panel having a plurality of groups of electrodes each provided with one of fluorescent materials different from one another and a driving circuit using subfield method, the plasma display device comprising:

an accumulator which accumulates a driven time of said plasma display device;

a memory which stores data for correcting a color temperature with respect to an elapsed driven time of the plasma display panel;

a controller which controls said accumulator, said memory and the driving circuit, and decides a number of discharge pulses supplied to said electrodes on the basis of a correction curve for the number of discharge pulses corresponding to color temperature correction; wherein said controller reads out data stored in said memory on the basis of said driven time; changeably controls the number of discharge pulses for at least one of said groups of electrodes provided on with one of said fluorescent materials on the basis of said data when an indicating signal concerning the color temperature correction is inputted, independently of an input signal; and controllably drives the driving circuit by using the discharge pulses so as to display at a predetermined color temperature; and a data converter which converts the decided number of discharge pulses decided by the controller into subfield data.

6. The plasma display device according to claim 5, wherein each of said electrodes is provided with one of three types of fluorescent materials of red, blue and green, and wherein at least the number of discharge pulses supplied to an electrode provided with blue fluorescent material is changeably controlled to increase on the basis of said discharge time.

7. The plasma display device according to claim 5, wherein each of said electrodes is provided with one of three types of fluorescent materials of red, blue and green, and wherein the number of discharge pulses supplied to electrodes each provided with red and green fluorescent materials are changeably controlled to decrease on the basis of said discharge time.

8. The plasma display device according to claim 5, further comprising a memory which stores data obtained based on said correction curve to be used to control the number of discharge pulses.

9. A plasma display device having a plurality of groups of electrodes, each of which is provided with one of luminescence medium different from one another, for displaying images by using a subfield method, the plasma display device comprising:

an accumulator which accumulates a discharge time of said plasma display device;

a controller which controls and decides a number of discharge pulses supplied to said electrodes on the basis of a correction curve for the number of discharge pulses corresponding to color temperature correction; and a data converter which converts the decided number of discharge pulses into subfield data;

wherein said number of discharge pulses of at least one of said groups of electrodes provided on with one of said luminescence medium is controlled on the basis of said discharge time when an indicating signal concerning the color temperature correction is inputted, independently of an input signal.

10. The plasma display device according to claim 9, further comprising a memory which stores data obtained based on said correction curve to be used to decide the number of discharge pulses.

11. A plasma display device including a plasma display panel having a plurality of groups of electrodes each provided with one of luminescence medium different from one another and a driving circuit using subfield method, the plasma display device comprising:

an accumulator which accumulates a driven time of said plasma display device;

a memory which stores data for correcting a color temperature with respect to an elapsed driven time of the plasma display panel;

a controller which controls said accumulator, said memory and the driving circuit, and decides a number of discharge pulses supplied to said electrodes on the basis of a correction curve for the number of discharge pulses corresponding to color temperature correction; wherein said controller reads out data stored in said memory on the basis of said driven time; changeably controls a number of discharge pulses for at least one of said groups of electrodes provided on with one of said luminescence medium on the basis of said data when an indicating signal concerning the color temperature correction is inputted, and each a time interval of changing said number of discharge pulses differing from one another, depending on the accumulated driven time of the plasma display device; and controllably drives the driving circuit by using he discharge pulses so as to display at a predetermined color temperature; and a data converter which converts the decided number of discharge pulses decided by the controller into subfield data.

12. The plasma display device according to claim 11, wherein said time interval of changing said number of discharge pulses becomes longer gradually, as said accumulated driven time of the plasma display device becomes longer.

13. The plasma display device according to claim 11, further comprising a memory which stores data obtained based on said correction curve to be used to decide the number of discharge pulses.

14. A plasma display device having a plurality of groups of electrodes, each of which is provided with one of fluorescent materials different from one another, for displaying images by using a subfield method, the plasma display device comprising:

an accumulator which accumulates a driven time of said plasma display device;

a controller which controls and decides a number of discharge pulses supplied to said electrodes on the basis of a correction curve for the number of discharge pulses corresponding to color temperature correction; and a data converter which converts the decided number of discharge pulses decided by the controller into subfield data;

wherein said number of discharge pulses of at least one of said groups of electrodes provided with one of said fluorescent materials is controlled based on said driven time when an indicating signal concerning the color temperature correction is inputted, each time interval of changing said number of discharge pulses differing from one another, depending on the accumulated driven time of the plasma display device.

15. The plasma display device according to claim 14, wherein each of said electrodes is provided with one of three types of fluorescent materials of red, blue and green, and wherein at least the number of discharge pulses supplied to an electrode provided with blue fluorescent material is changeably controlled based on said driven time.

16. The plasma display device according to claim 14, wherein each of said electrodes is provided with one of three types of fluorescent materials of red, blue and green, and wherein the number of discharge pulses supplied to electrodes each provided with red and green fluorescent materials are changeably controlled based on said driven time.

17. The plasma display device according to claim 14, wherein said time interval of changing said number of discharge pulses becomes longer gradually, as said accumulated driven time of the plasma display device becomes longer.

18. The plasma display device according to claim 14, further comprising a memory which stores data obtained based on said correction curve to be used to control the number of discharge pulses.

* * * * *